US010669980B2

(12) United States Patent
Chu et al.

(10) Patent No.: US 10,669,980 B2
(45) Date of Patent: Jun. 2, 2020

(54) METHOD, APPARATUS, AND SYSTEM FOR LAUNCHING ENGINE START-STOP FUNCTION IN VEHICLES

(71) Applicant: Beijing Xiaomi Mobile Software Co., Ltd., Haidian District, Beijing (CN)

(72) Inventors: Yueyue Chu, Beijing (CN); Yan Xie, Beijing (CN); Da Wang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 141 days.

(21) Appl. No.: 15/711,682

(22) Filed: Sep. 21, 2017

(65) Prior Publication Data

US 2018/0128231 A1 May 10, 2018

(30) Foreign Application Priority Data

Nov. 7, 2016 (CN) ..... 2016 1 0978818

(51) Int. Cl.
*F02N 11/08* (2006.01)
*G08G 1/0967* (2006.01)
(Continued)

(52) U.S. Cl.
CPC ..... *F02N 11/0837* (2013.01); *F02N 11/0807* (2013.01); *G08G 1/0133* (2013.01);
(Continued)

(58) Field of Classification Search
CPC ..... F02N 11/0807; F02N 11/0837; F02N 2200/125; F02N 2300/2011; F02N 2300/306; G08G 1/096725
See application file for complete search history.

(56) References Cited

U.S. PATENT DOCUMENTS 6,629,515 B1 * 10/2003 Yamamoto ..... B60K 6/485 123/179.4
2002/0148424 A1 * 10/2002 Wakabayashi ..... F02N 11/0837 123/179.4
(Continued)

FOREIGN PATENT DOCUMENTS

CN 102582619 A 7/2012
CN 104553795 A 4/2015
(Continued)

OTHER PUBLICATIONS

Chinese Office Action (including English translation) issued in corresponding CN Patent Application No. 201610978818A, dated Nov. 22, 2018, 52 pages.
(Continued)

*Primary Examiner* — Sizo B Vilakazi
*Assistant Examiner* — Anthony L Bacon
(74) *Attorney, Agent, or Firm* — Arch & Lake LLP

(57) ABSTRACT

The disclosure is related to methods, apparatuses, and systems for launching an engine start-stop function in vehicles. A vehicle terminal may transmit to a server a traffic information acquiring instruction which carries current location information for the vehicle; receive traffic information transmitted by the server; and launch the engine start-stop function for the vehicle when the traffic information satisfies a preset condition. The server may acquire the traffic information of a road at which the vehicle is located currently after receiving the traffic information acquiring instruction and transmit the acquired traffic information to the vehicle terminal. Whether to launch the engine start-stop function may be based on the traffic information such that, for example, the engine is not stopped when the vehicle is expected to be stopped for too brief a time period.

15 Claims, 7 Drawing Sheets

(51) Int. Cl.
*G08G 1/096* (2006.01)
*G08G 1/01* (2006.01)

(52) U.S. Cl.
CPC ..... *G08G 1/096* (2013.01); *G08G 1/096725* (2013.01); *F02N 2200/125* (2013.01); *F02N 2300/2011* (2013.01); *F02N 2300/306* (2013.01)

(56) References Cited

U.S. PATENT DOCUMENTS

2009/0299549 A1* 12/2009 Albertson ..... B60W 10/06 701/2
2010/0010729 A1* 1/2010 Hutchinson ..... G08G 1/096725 701/117
2012/0022718 A1* 1/2012 Neelakantan ..... B60T 7/18 701/2
2012/0029730 A1* 2/2012 Nagura ..... F02N 11/0837 701/2
2012/0191330 A1* 7/2012 Nitz ..... F02N 11/0822 701/113
2014/0371951 A1* 12/2014 Michael ..... F02N 11/0807 701/2
2015/0248836 A1* 9/2015 Alselimi ..... G06K 9/00785 348/149
2017/0080919 A1* 3/2017 Follen ..... B60W 20/12
2017/0124869 A1* 5/2017 Popple ..... G08G 1/096725
2017/0197617 A1* 7/2017 Penilla ..... B60W 30/09
2018/0273020 A1* 9/2018 Kruse ..... F02N 11/0837

FOREIGN PATENT DOCUMENTS

CN 105405286 A 3/2016
CN 105632214 A 6/2016
CN 105799704 7/2016
CN 105849790 A 8/2016
EP 0720929 A1 7/1996
EP 2161697 A1 3/2010
JP 2003041964 A 2/2003
WO WO-2009116708 A1 * 9/2009 ..... B60W 10/06

OTHER PUBLICATIONS

Extended European Search Report issued in corresponding European Application No. 17191632.3, dated Mar. 14, 2018, 7 pages.

* cited by examiner

METHOD, APPARATUS, AND SYSTEM FOR LAUNCHING ENGINE START-STOP FUNCTION IN VEHICLES

CROSS-REFERENCE TO RELATED APPLICATION

This application is based on and claims priority to Chinese Patent Application No. CN201610978818.X, filed on Nov. 7, 2016, which is incorporated herein by reference in its entirety.

FIELD

The present disclosure generally relates to a vehicle terminal capable of affecting engine start-stop functionality in vehicles, and more particularly, to methods, apparatuses, and systems for launching an engine start-stop function based on traffic-related information.

BACKGROUND

With the development of improved automobile manufacturing technologies, new cars can be equipped with engine start-stop functionality. The engine start-stop capability of a vehicle allows, when a brake pedal is pressed to stop the vehicle, an engine of the vehicle to be stopped (i.e., partially or entirely shut off) to save fuel. When stopped, lubricating oil inside the engine may continue to run to keep the engine lubricated. When the brake pedal is released or a clutch depressed, the engine may start again (i.e., the engine may be fired up) so the vehicle can proceed. Although circulating lubricant inside the engine can prevent damage to the engine during normal operations, frequent starts and stops that are too frequent could introduce additional wear and tear over time and potentially use more fuel than would otherwise be used. Moreover, although the engine can be started relatively quickly, there can be a small delay between the time the brake is released and the time the engine restarts to move the vehicle again. Consequently, if the vehicle start-stop function is launched every time the vehicle comes to a stop, even if the vehicle will only remain stopped for a very short time (say, a few seconds), the start-stop functionality may be undesirable.

In the related art, when a user encounters a traffic light or congestion while driving, the user will press the brake pedal, and a vehicle terminal automatically launches the engine start-stop function after detecting that the vehicle is in a stop state (e.g., has come to a stop), thereby turning the engine off. This occurs without consideration for how long the vehicle is expected to remain stopped before needing to start again.

SUMMARY

In view of the related art, example methods, apparatuses, and systems for launching an engine start-stop function are provided in the disclosure.

In a first aspect, a method may be implemented in a vehicle terminal of a vehicle, for launching an engine start-stop function in the vehicle. The method may include: transmitting, from the vehicle terminal to a server, a traffic information acquiring instruction which carries current location information of the vehicle, the traffic information acquiring instruction and current location information being used by the server to acquire traffic information for a road on which the vehicle is located currently as determined based on the current location information, the traffic information indicating a current traffic condition corresponding with traffic flow on the road; receiving, at the vehicle terminal, the traffic information transmitted by the server; and launching the engine start-stop function for the vehicle when the traffic information meets a preset condition, the preset condition corresponding with a period of time during which the vehicle is anticipated to remain stopped based on the traffic information, the start-stop function configured to stop the engine while the vehicle is stopped and restart the engine when the vehicle is to move again.

In a second aspect, an apparatus for launching an engine start-stop function in a vehicle, comprises: a first transmission module configured to transmit to a server a traffic information acquiring instruction which carries current location information of the vehicle, the traffic information acquiring instruction used by the server to acquire traffic information for a road at which the vehicle is located currently as determined based on the location information, the traffic information indicating a current traffic condition for the road; a first reception module configured to receive traffic information transmitted by the server; and a launch module configured to launch the engine start-stop function for the vehicle when the traffic information satisfies a preset condition, the preset condition corresponding with a period of time during which the vehicle is anticipated to remain stopped based on the traffic information, the start-stop function configured to stop the engine while the vehicle is stopped and restart the engine when the vehicle is to move again.

In a third aspect, a computer-readable medium has instructions thereon that when executed cause a vehicle terminal to: transmit to a server a traffic information acquiring instruction which carries current location information for a vehicle, the traffic information acquiring instruction used by the server to acquire traffic information of a road at which the vehicle is located currently as determined based on the location information, the traffic information indicating current traffic condition of the road; receive the traffic information transmitted by the server; and launch an engine start-stop function for the vehicle when the traffic information satisfies a preset condition, the preset condition corresponding with a period of time during which the vehicle is anticipated to remain stopped based on the traffic information, the start-stop function configured to stop the engine while the vehicle is stopped and restart the engine when the vehicle is to move again.

It is to be understood that both the forgoing general description and the following detailed description are exemplary and illustrative only, and will not limit the present disclosure.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Exemplary embodiments are described in detail herein, example implementations of which are illustrated in the accompanying drawings. The following description refers to the accompanying drawings in which same numbers in different drawings represent same or similar elements unless otherwise described. The implementations set forth in the following description of exemplary embodiments do not represent all implementations consistent with the invention. Instead, they are merely examples of apparatuses, systems, and methods consistent with aspects related to the invention as recited in the appended claims.

An application scenario of the present disclosure is described before detailing example embodiments of the present disclosure. With the development of automobile manufacturing technologies, currently most new cars have engine start-stop functionality. The vehicle terminal may launch (i.e., engage, enable, activate, implement, etc.) the engine start-stop function when the brake pedal is detected to be pressed by the user to stop the engine because of, for example, a red traffic light or road congestion (i.e., anything affecting traffic flow or in the path of the vehicle, such as other vehicles, construction equipment, pedestrians, bicyclists, etc.) while the vehicle is being driven. In practice, when there is a traffic light or road congestion while the vehicle is running, the waiting time at a red light or the waiting time for the road congestion may be relatively short. Therefore, the user may not want the engine start-stop function to be launched to thereby stop the engine until the vehicle is to move again. The vehicle terminal may nonetheless launch the engine start-stop function once the brake pedal is detected to be pressed, which may annoy the user, may be inefficient, and/or may be harmful to the engine over time. In order to address the problem, the vehicle terminal may, in example implementations, transmit a traffic information acquiring instruction (e.g., a request for traffic information) to a server (which may be any networked computing device or devices). The server may acquire (i.e., obtain, retrieve, or otherwise access from, for example, other devices, memory, databases, etc.) traffic information for a road (or segment thereof) or otherwise the vicinity at which the vehicle is located currently after receiving the traffic information acquiring instruction, and the server may transmit the acquired traffic information to the vehicle terminal. The vehicle terminal may determine whether to launch the engine start-stop function based on the traffic condition of the road at which the vehicle is located currently.

Figure 1:
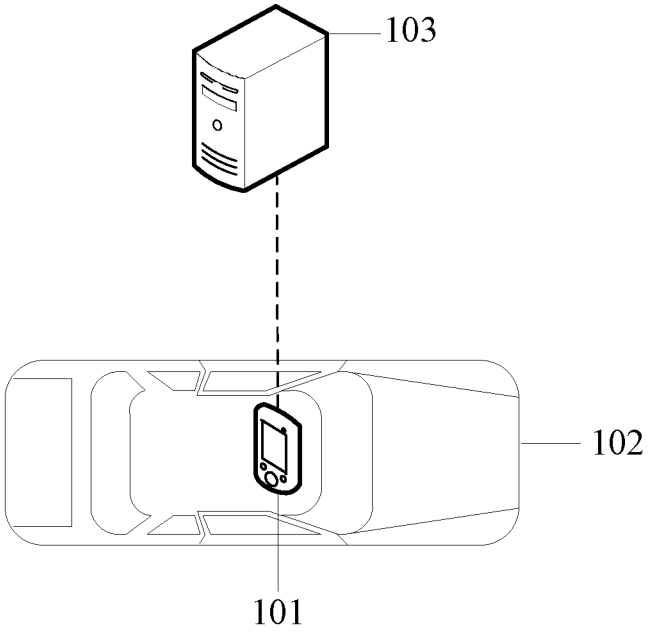
FIG. 1 is an example system architecture diagram according to one or more embodiments of the present disclosure.

FIG. 1 is an example system architecture diagram according to one or more embodiments of the present disclosure. The system architecture may be applied to various types of vehicles. Also, example embodiments discussed below may be implemented using the system architecture represented here.

In FIG. 1, the system architecture may include a vehicle terminal 101, a vehicle 102, and a server 103. The vehicle terminal 101 may be installed inside or otherwise incorporated with the vehicle 102. The vehicle terminal 101 may monitor and manage operations of the vehicle 102, and may have access to, for example, data from sensors in the vehicle, information obtained through user input, and information received from other devices and computers through wireless communications. The vehicle terminal 101 may be connected with the server 103 through a wireless network. This system architecture may be applied to any of the implementations discussed blow.

Figure 2:
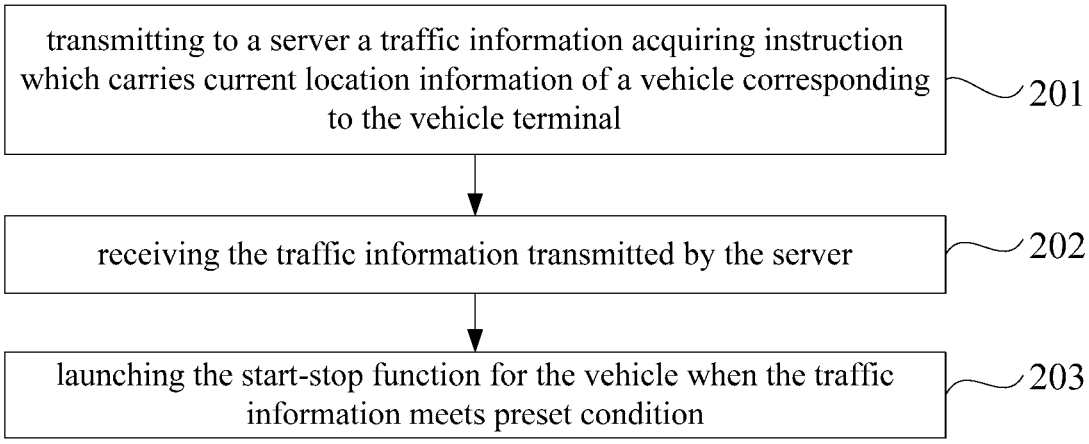
FIG. 2 is a flow diagram illustrating an example method for launching an engine start-stop function according to one or more embodiments.

FIG. 2 is a flow diagram illustrating an example method for launching an engine start-stop function according to one or more embodiments. Referring to FIG. 2, the method for launching the engine start-stop function may be applied in a vehicle terminal and may include the following operations.

In 201, a traffic information acquiring instruction is transmitted to a server by a vehicle terminal. In various implementations, the traffic information acquiring instruction may be transmitted, for example, when the vehicle has already come to a complete stop, when the vehicle has a deceleration value greater than a threshold (e.g., when the vehicle is reducing speed quickly and may thus be coming to a stop), when the vehicle is decelerating while traveling at a speed that is below a threshold value (e.g., when the vehicle is slowing down when going relatively slowly, such as below 10 miles per hour (mph), suggesting the vehicle may be coming to a stop), when the vehicle is decelerating while traveling on a road with a density of traffic lights exceeding a threshold (e.g., when traffic lights are abundant on a road and the vehicle is slowing down, suggesting the vehicle may be coming to a stop because of a red light), or at other times deemed suitable to receiving information useful to determining whether to launch the engine start-stop function. The traffic information acquiring instruction may carry (i.e., include, be accompanied by, identify, etc.) current location information for a vehicle corresponding to (operating with) the vehicle terminal. The traffic information acquiring instruction may be used by (i.e., executed or otherwise acted upon by) the server to acquire traffic information for a road at which the vehicle is located currently (as determined from the location information). The traffic information may indicate/inform about current traffic conditions on the road. The traffic condition may be based on any factors affecting congestion, delays, and/or vehicle flow, such as the number and speed of vehicles, number and stop-time of traffic lights (e.g., how long cars are stopping at red lights), construction, accidents, broken-down vehicles, weather-related factors (such as floods and storms), etc.

In 202, the traffic information transmitted by the server is received at the vehicle terminal.

In 203, the engine start-stop function for the vehicle is launched when the traffic information meets/satisfies a preset condition (such as a traffic condition).

According to one or more embodiments of the disclosure, the vehicle terminal may transmit a traffic information acquiring instruction to the server to acquire the traffic information of a road at which the vehicle is located currently, receive the traffic information, and then launch the engine start-stop function for the vehicle when the traffic information meets the preset condition. As a result, the vehicle terminal may determine whether to launch the engine start-stop function based on a traffic condition of the road at which the vehicle is located currently, and thus it can avoid launching the engine start-stop function too frequently within a short period, since the start-stop function would otherwise automatically be launched once the brake pedal is detected to be pressed without consideration for the traffic information. Therefore, the engine start-stop function is more convenient, efficient, and/or user-friendly, and the user would be more willing to use the engine start-stop function, and thus usage and operation of the engine start-stop function is improved.

Optionally, the method may further include: detecting a current state of the vehicle; and acquiring a current location information of the vehicle when it is detected that the current state of the vehicle is in a stop state. Other states include deceleration exceeding a threshold (optionally, in combination with a sufficiently low speed), indicating the vehicle is likely coming to a stop.

Optionally, the traffic information may be current traffic light information for location of a traffic light at which the vehicle is located. The traffic light information may be based on, for example, how long a specific traffic light stays red by programming (e.g., the light may be programmed to remain red for two minutes at a time), how long the traffic light has been staying red within a recent period (such as the previous 15 minutes) due to current traffic conditions, etc. Launching the start-stop function for the vehicle when the traffic information meets the preset condition may include: determining waiting time at a red light for the vehicle continuing to wait at the red light at the location of the traffic light based on the current traffic light information; and launching the start-stop function for the vehicle when the waiting time at the red light is longer than a preset threshold (such as 15 seconds, 30 seconds, 1 minute, etc.).

Optionally, the traffic information may be real time road condition information for the road (or segment thereof) at which a vehicle is located. Launching the start-stop function for the vehicle when the traffic information meets the preset condition may include: determining congestion time (e.g., delay time, wait time, etc.) for the road or traffic congestion index for the road based on the real time road condition information for the road; and launching the start-stop function for the vehicle when the congestion time is greater than a preset threshold, and/or when the traffic congestion index satisfies a preset index condition. The congestion index may be a measure or classification corresponding with traffic levels. This may be based on, for example, current or historical values for average delays, average speed relative to speed limit, number of vehicles relative to vehicle capacity for the road (which may take into account whether the vehicles are large trucks that tend to cause greater delay because of their size and speed relative to passenger vehicles) density of traffic lights in a segment of the road, time of day (e.g., time corresponding with "rush hour" or peak congestion times), whether driving conditions are "stop and go" (with only brief stops, which may be too brief to justify launching the engine start-stop function), etc.

Figure 3:
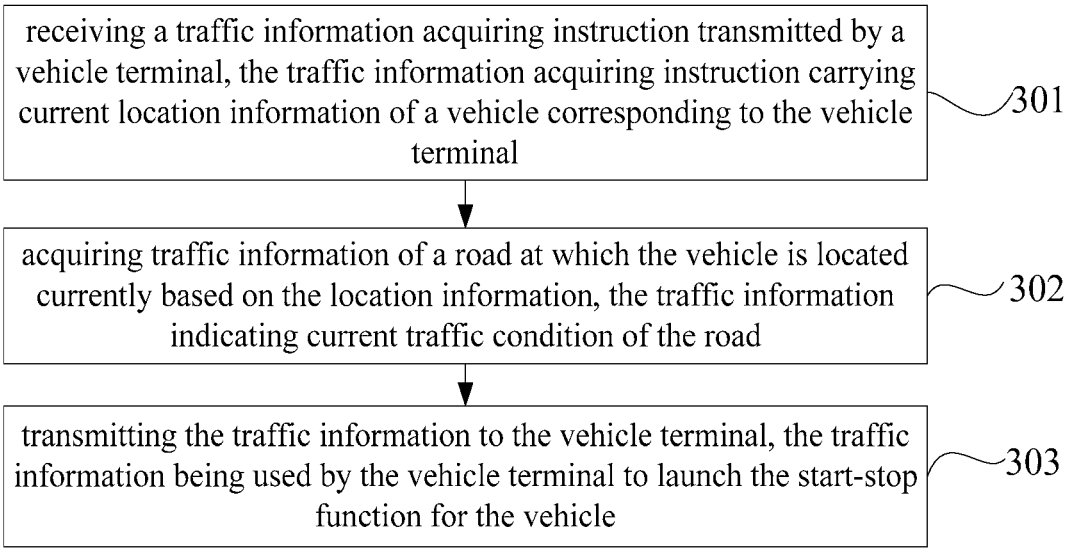
FIG. 3 is a flow diagram illustrating an example method for launching an engine start-stop function according to one or more embodiments.

FIG. 3 is a flow diagram illustrating an example method for launching an engine start-stop function according to one or more embodiments. Referring to FIG. 3, the method for launching the start-stop function may be implemented in a server and may include the following operations.

In 301, a traffic information acquiring instruction transmitted by the vehicle terminal is received by the server. The traffic information acquiring instruction may carry current location information for the vehicle corresponding to the vehicle terminal.

In 302, the traffic information of the road at which the vehicle is located currently is acquired based on the location information. The traffic information may indicate current traffic conditions for the road.

In 303, the traffic information is transmitted to the vehicle terminal. The traffic information may be used by the vehicle terminal to determine whether to launch the engine start-stop function for the vehicle.

According to one or more embodiments of the disclosure, the server may receive the traffic information acquiring instruction from the vehicle terminal, acquire the traffic information of the road at which the vehicle corresponding to the vehicle terminal is located currently based on the location information in the traffic information acquiring instruction, and transmit the acquired traffic information to the vehicle terminal. The traffic information is preferably "live" (i.e., updated as changes occur), but if live information is not available, the traffic information may be based on historical traffic levels, for example, at the time of day, around special events (e.g., a traffic light at a stadium around start or end time for a sporting event is likely to have higher delays than when there is no event at the stadium), etc. As a result, the vehicle terminal may determine whether to launch the engine start-stop function based on the traffic information, and thus it can avoid launching the start-stop function too frequently within a short period since the start-stop function would otherwise automatically launch once the brake pedal is detected to be pressed regardless of traffic information. Therefore, it is convenient for the user to use the start-stop function and the user would be more willing to use the start-stop function, and thus usage and operation of the start-stop function is improved.

Optionally, the traffic information may be current traffic light information for location of a traffic light at which the vehicle is located. Acquiring the traffic information for the road at which the vehicle is located currently based on the location information may include: determining the location of the traffic light at which the vehicle is located based on the location information; and acquiring the current traffic light information (which may include the amount of time the traffic light is currently, or has been recently, remaining red) for the location of the traffic light.

Optionally, the traffic information may be real time road condition information for the road. Acquiring the traffic information of the road at which the vehicle is located currently based on the location information may include: determining the road at which the vehicle is located currently based on the location information; and acquiring the real time road condition information of the road.

Figure 4:
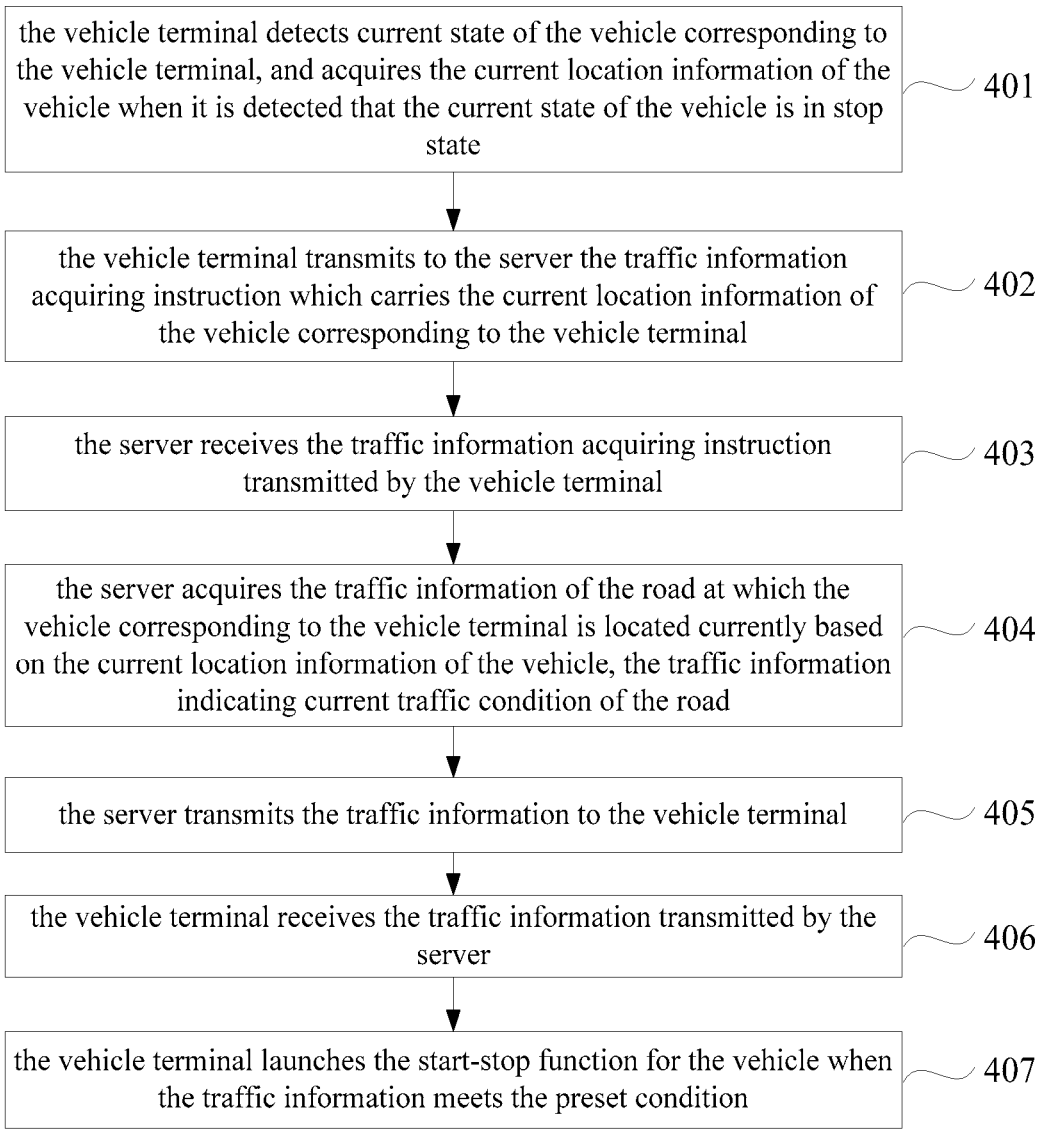
FIG. 4 is a flow diagram illustrating an example method for launching an engine start-stop function according to one or more embodiments.

FIG. 4 is a flow diagram illustrating an example method for launching an engine start-stop function according to one or more embodiments. Referring to FIG. 4, the method for launching start-stop function may include the following operations.

In 401, the vehicle terminal detects a current state of the vehicle corresponding to the vehicle terminal, and acquires the current location information of the vehicle when the vehicle terminal has detected that the current state of the vehicle is a stop state (e.g., the vehicle has come to a complete stop).

The vehicle terminal may detect the current state of the vehicle by detecting current running speed of the vehicle or by determining whether the vehicle is in an idle state (e.g., the vehicle is in neutral). It may be determined that the vehicle is in a stop state when it is detected that the current running speed of the vehicle is zero or the vehicle is in an idle state. When the vehicle terminal detects that the current state of the vehicle becomes a stop state, the vehicle terminal may acquire the current location information of the vehicle through on-board GPS (Global Positioning System). The location information may be longitude and latitude of the current location or information about the road at which the vehicle is located currently. Also, the location information may be other information which may indicate the current location of the vehicle. The location information may include, for example, addresses, intersections, mile markers, etc.

In 402, the vehicle terminal transmits to the server the traffic information acquiring instruction which carries the current location information of the vehicle corresponding to the vehicle terminal.

In 403, the server receives the traffic information acquiring instruction transmitted by the vehicle terminal.

In 404, the server acquires the traffic information for the road at which the vehicle corresponding to the vehicle terminal is located currently based on the current location information of the vehicle. The traffic information may indicate current traffic condition of the road.

The traffic information may be the current traffic light information for the location of the traffic light at which the vehicle is located. Or, the traffic information may be real time road condition information for the road at which the vehicle is located currently. The real time road condition information may indicate, for example, the degree of congestion (such as delay times) for the road at which the vehicle is located currently.

In the case that the traffic information is the current traffic light information for the location of the traffic light at which the vehicle is located, the operation 404 may include: determining running/travel direction of the vehicle; determining the location of a traffic light through which the vehicle is going to pass (once the light turns green) based on the current location information and the running direction of the vehicle, the location of the traffic light through which the vehicle is going to pass being the location of the traffic light at which the vehicle is located currently; and acquiring the current traffic light information for the location of the traffic light at which the vehicle is located currently based on the location of the traffic light at which the vehicle is located currently.

Prior to operation 404, the server may receive at least two current locations of the vehicle transmitted by the vehicle terminal, and determine the running direction of the vehicle based on the at least two current locations. The two current locations may include a first location determined at a first time, and a second location determined at a second time that is a brief period (such as 5 seconds) after the first time. Alternatively, the vehicle terminal may transmit a starting location and a target location to the server while the vehicle is running in order to request the server to plan a travel route for the vehicle, so that the server may determine the running direction of the vehicle based on the direction of travel required to get from the starting location to the target location of the vehicle. (This planning may also include determining, for example, the traffic light density and delay times for the travel route for use in deciding whether the engine start-stop function should be launched.)

The traffic light information may be remaining time for a red light for the vehicle waiting at the red light at the location of the traffic light, or may be start time and end time of current state (e.g., red light) of the traffic light at the location of the traffic light.

There may be a plurality of traffic lights for a plurality of lanes at the location of the traffic light. For example, there may be a traffic light for a through lane, a traffic light for a left-turn lane, and a traffic light for a right-turn lane. Thus, the acquired current traffic light information may include current traffic light information for multiple lanes at the location of the traffic light, or may be current traffic light information for the particular lane at which the vehicle is located currently.

If acquiring the current traffic light information for the lane at which the vehicle is located is impractical, the lane at which the vehicle is located may be deduced based on the location of the traffic light at which the vehicle is located currently, and then the traffic light information corresponding to the lane may be extracted from the current traffic light information (e.g., which lights are currently red and which are green), for the location of the traffic light. For example, if it is determined that a left-turn light is the only one that is red, and if the vehicle is stopped at that intersection, it may be deduced that the vehicle is likely stopped at the left-turn light, and the determination of whether to launch the engine start-stop function may be based on, for example, the remaining red time for the left-turn light.

The server may store traffic light information for various locations of traffic lights for various roads. Moreover, the stored traffic light information may change in real time. Alternatively, a traffic command server, rather than the server, may store the traffic light information for various locations of traffic lights for various roads. Moreover, the stored traffic light information in the traffic command server may change in real time.

Accordingly, the server may acquire traffic information for the road where the vehicle is located currently from the traffic light information for various locations of traffic lights stored therein based on the current location information of the vehicle. Alternatively, the server may acquire traffic information for the road where the vehicle is located currently from the traffic light information for various locations of traffic lights stored in the traffic command server based on the current location information of the vehicle.

Furthermore, the remaining time of red light for the vehicle waiting at the red light at the location of the traffic light may be the remaining time of red light for the lane at which the vehicle is located currently acquired, or may be the remaining time of red light for various lanes at the location of the traffic light acquired.

The operations to acquire the remaining time of red light for the lane at which the vehicle is located currently may be performed as follows, in various implementations. The lane at which the vehicle is located may be determined based on the location of the traffic light at which the vehicle is located currently, and then the remaining time of red light corresponding to the lane may be extracted from the current traffic light information for the location of the traffic light.

The operations to acquire the remaining time of red light for the various lanes at the location of the traffic light may be performed as follows, in various implementations. The current traffic light state of various lanes at the location of the traffic light may be determined based on the location of the traffic light at which the vehicle is located currently. The state of the traffic light may include red light state, yellow light state, green light state, and flashing-yellow light state. Then the remaining time of red light for a lane that is in the red light state may be acquired among the various lanes.

Furthermore, start time and end time for the current state of the traffic light at the location of the traffic light may be the start time and the end time of the current state of the traffic light for the lane where the vehicle is located currently acquired, or may be the start time and the end time of the current state of the traffic lights for various lanes at the location of the traffic light acquired.

The operations to acquire the start time and the end time of the current state of the traffic light for the lane where the vehicle is located currently may be performed as follows, in various implementations. The lane where the vehicle is located may be determined based on the location of the traffic light where the vehicle is located currently. Then the start time and the end time of the current state of the traffic light corresponding to the lane may be extracted from the current traffic light information for the location of the traffic light.

The operations to acquire the start time and the end time of the current state of the traffic lights for various lanes at the location of the traffic light may be performed as follows, in various implementations. The current state of the traffic lights for various lanes at the location of the traffic light may be determined based on the location of the traffic light where the vehicle is located currently. The state of the traffic lights may include red light state, yellow light state, green light state, and flashing-yellow light state. Then the start time and the end time of the current state of the traffic lights for the various lanes may be acquired.

In the case that the traffic information is the real time road condition information of the road at which the vehicle is located currently, the operation 404 may include: determining the road where the vehicle is located currently based on the location information; and acquiring the real time road condition information of the road.

The real time road condition information of the road may include estimated passing time when the road is congested, and historical passing time when the road is clear. Alternatively, the real time road condition information of the road may include traffic congestion index of the road, or congestion time of the road, which may be the difference between the estimated passing time and the historical passing time.

In operation 404, the server may acquire the real time road condition information of the road from a third party server based on the road where the vehicle is located currently. The third party server may be a server which may provide map service or monitor road conditions in real time. For example, the third party server may be a map server or a traffic command server. The traffic command server may be used by the authorities to monitor the road condition in real time.

In 405, the server transmits the traffic information to the vehicle terminal.

In 406, the vehicle terminal receives the traffic information transmitted by the server.

In 407, the vehicle terminal launches the engine start-stop function for the vehicle when the traffic information meets the preset condition.

The vehicle terminal may determine whether the traffic information meets the preset condition after receiving the traffic information transmitted by the server. When the traffic information meets the preset condition, the engine start-stop function for the vehicle is launched. When the traffic information does not meet the preset condition, the engine start-stop function for the vehicle is not launched (i.e., disengaged, disabled, deactivated, not implemented, etc.).

Optionally, in the case that the traffic information is the current traffic light information for the location of the traffic light where the vehicle is located, the operation 407 may include: determining the waiting time at a red light for the vehicle continuing to wait at the red light at the location of the traffic light based on the current traffic light information; and launching the engine start-stop function for the vehicle when the waiting time at the red light is greater than a preset threshold.

Below are several example implementations to determine the waiting time at a red light for the vehicle continuing to wait at the red light at the location of the traffic light based on the current traffic light information. It is noted that anticipated wait times (i.e., the length of time during which the vehicle is expected to remain stopped) may be affected by other factors, such as proximity to the red light. For example, the farther away a vehicle is from an intersection when stopped because of a red light, the greater the potential delay, as other vehicles ahead must start moving once the light turns green before the user's vehicle can start moving as well. These other factors may also be taken into account in deciding whether to launch the engine start-stop function.

In a first example implementation: if the traffic light information includes the remaining time of red light for the lane where the vehicle is located currently, the remaining time of red light may be used as the waiting time at a red light for the vehicle continuing to wait at the red light. If the wait time is less than a threshold, it may be determined that the vehicle will be stopped for too brief of a time to justify launching the engine start-stop function.

In a second example implementation: if the traffic light information includes respective remaining time of red light for various lanes at the location of the traffic light, the vehicle terminal may locate the lane where the vehicle is located currently based on the location information, determine location using, for example, sensors that detect surroundings, or acquire the lane where the vehicle is located currently based on a selection by the user, and determine the remaining time of red light for the lane where the vehicle is located currently as the waiting time at the red light for the vehicle continuing to wait at the red light.

The third example implementation: if the traffic light information includes the start time and the end time of the current state of the traffic light for the lane where the vehicle is located currently and the current state of the traffic light is in a red light state, the vehicle terminal may calculate the remaining time of the current state of the traffic light based on current time, the start time, and the end time of the current state of the traffic light, and determine the remaining time as the waiting time at a red light for continuing to wait at the red light. For example, if the current time is 12:08 and the end time is 12:10, it may be determined that the remaining wait time is two minutes.

The fourth example implementation: if the traffic light information includes the start time and the end time of the current state of the traffic lights for various lanes at the location of the traffic light and the current state of the traffic lights is in red light state, the vehicle terminal may locate the lane where the vehicle is located currently based on the location information, determine location using, for example, sensors that detect surroundings, or acquire the lane where the vehicle is located currently based on a selection by the user, acquire the start time and the end time of the traffic light for the lane where the vehicle is located currently, subsequently calculate the remaining time of the current state of the traffic light for the lane where the vehicle is located currently based on the current time, the start time, and the end time of the current state of the traffic light for the lane, and determine the remaining time as the waiting time at a red light for continuing to wait at the red light.

Optionally, in the case that the traffic information is the real time road condition information of a road, the operation 407 may include: determining the congestion time of the road or the traffic congestion index of the road based on the real time road condition information of the road, and launching the start-stop function for the vehicle when the congestion time is greater than a preset threshold or the traffic congestion index satisfies a preset index condition.

If the real time road condition information includes the estimated passing time when the road is congested and the historical passing time when the road is clear, the vehicle terminal may calculate the difference between the estimated passing time and the historical passing time, determine the calculated difference as the congestion time of the road, and launch the engine start-stop function for the vehicle when the congestion time is greater than the preset threshold.

Optionally, in the case that the real time road condition information includes the traffic congestion index of the road, the vehicle terminal may determine whether the traffic congestion index is greater than the preset index and launch the start-stop function for the vehicle when the traffic congestion index is greater than the preset index.

Optionally, in the case that the real time road condition information includes the congestion time of the road, the vehicle terminal may directly determine whether the congestion time is longer than the preset threshold and launch the start-stop function for the vehicle when the congestion time is longer than the preset threshold.

According to example embodiments of the disclosure, the vehicle terminal may transmit a traffic information acquiring instruction to the server; the server may acquire the traffic information of the road at which the vehicle corresponding to the vehicle terminal is located currently after receiving the traffic information acquiring instruction, and transmit the acquired traffic information to the vehicle terminal. As a result, the vehicle terminal may determine whether to launch the start-stop function based on the traffic condition of the road at which the vehicle is located currently, and thus it can avoid launching the start-stop function too frequently within a short period since the start-stop function will otherwise automatically be launched once the brake pedal is detected to be pressed regardless of the traffic information. Therefore, it is convenient for the user to use the start-stop function, and the user would be more willing to use the start-stop function, and thus usage and operation of the start-stop function is improved.

Figure 5A:
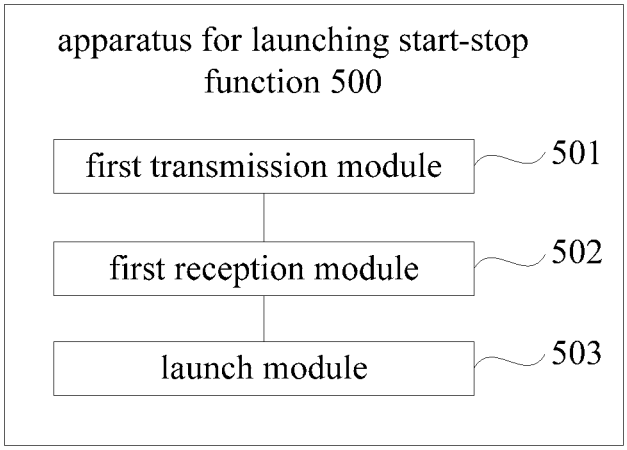
FIG. 5A is a block diagram illustrating an example apparatus for launching an engine start-stop function according to one or more embodiments.

FIG. 5A is a block diagram illustrating an example apparatus 500 for launching an engine start-stop function according to one or more embodiments. Referring to FIG. 5A, the apparatus may be applied in a vehicle terminal and include a first transmission module 510, a first reception module 502, and a launch module 503.

The first transmission module 501 may be configured to transmit to a server a traffic information acquiring instruction. The traffic information acquiring instruction may carry current location information of a vehicle corresponding to the vehicle terminal and may be used by the server to acquire traffic information of a road at which the vehicle is located currently based on the location information. The traffic information may indicate current traffic condition of the road.

The first reception module 502 may be configured to receive the traffic information transmitted by the server.

The launch module 503 may be configured to launch the engine start-stop function for the vehicle when the traffic information meets a preset condition.

Figure 5B:
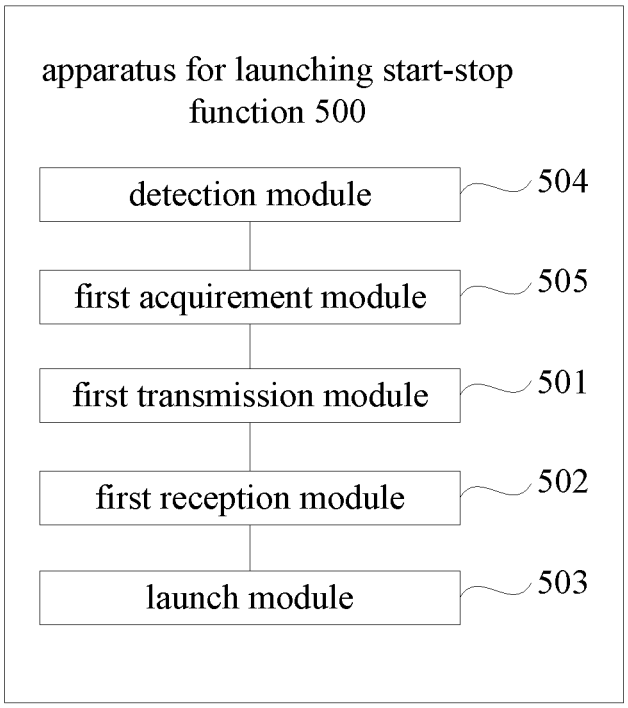
FIG. 5B is a block diagram illustrating an example apparatus for launching an engine start-stop function according to one or more embodiments.

Optionally, referring to FIG. 5B, the apparatus may further include a detection module 504 configured to detect current state of the vehicle, and a first acquirement module 505 configured to acquire the current location information of the vehicle when it is detected that the current state of the vehicle is in a stop state.

Figure 5C:
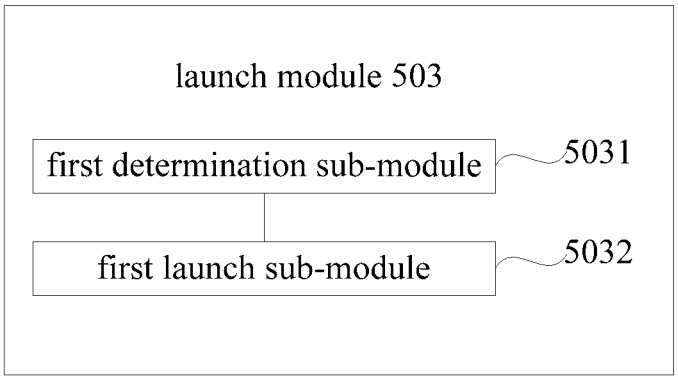
FIG. 5C is a block diagram illustrating an example launch module according to one or more embodiments.

Optionally, referring to FIG. 5C, the traffic information is the current traffic light information for the location of the traffic light at which the vehicle is located.

The launch module 503 may include a first determination sub-module 5031 and a first launch sub-module 5032. The first determination sub-module 5031 may be configured to determine waiting time at a red light for the vehicle continuing to wait at a red light at the location of the traffic light based on the current traffic light information. The first launch sub-module 5032 may be configured to launch the start-stop function for the vehicle when the waiting time at the red light is longer than a preset threshold.

Figure 5D:
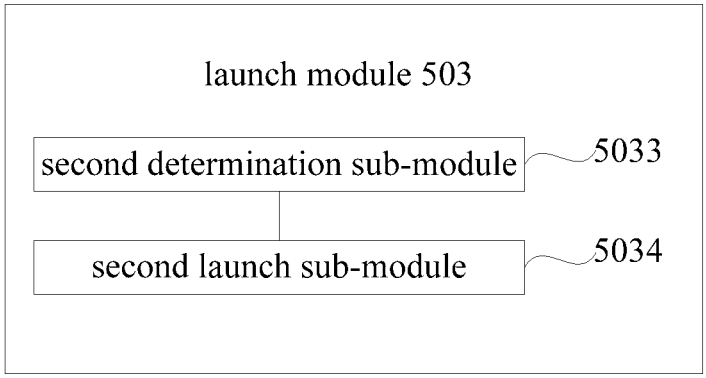
FIG. 5D is a block diagram illustrating an example launch module according to one or more embodiments.

Optionally, referring to FIG. 5D, the traffic information is real time road condition information of the road.

The launch module 503 may include a second determination sub-module 5033 and a second launch sub-module 5034. The second determination sub-module 5033 may be configured to determine congestion time of the road or traffic congestion index of the road based on the real time road condition information of the road. The second launch sub-module 5034 may be configured to launch the engine start-stop function for the vehicle when the congestion time is longer than a preset threshold or the traffic congestion index is a preset index.

According to example embodiments of the disclosure, the vehicle terminal may transmit a traffic information acquiring instruction to the server to acquire the traffic information of a road at which the vehicle is located currently, receive the traffic information, and then launch the start-stop function for the vehicle when the traffic information meets the preset condition. As a result, the vehicle terminal may determine whether to launch the start-stop function based on the traffic condition of the road at which the vehicle is located currently, and thus it can avoid launching the start-stop function too frequently within a short period since the start-stop function will be automatically launched once the brake pedal is detected to be pressed without consideration of traffic information. Therefore, it is convenient for the user to use the start-stop function and the user would be more willing to use the start-stop function, and thus usage and operation of the start-stop function is improved.

Figure 6A:
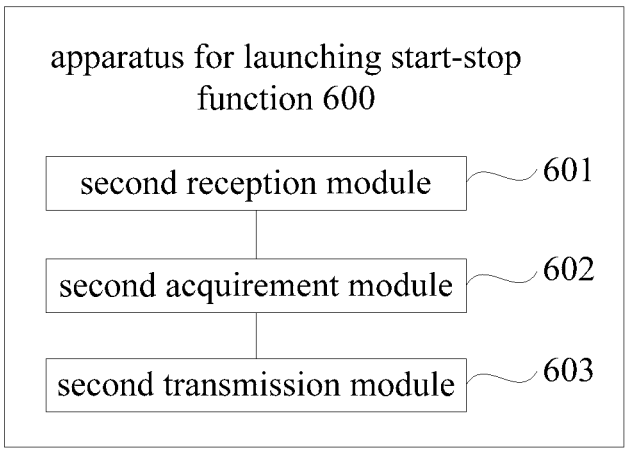
FIG. 6A is a block diagram illustrating an example apparatus for launching an engine start-stop function according to one or more embodiments.

FIG. 6A is a block diagram illustrating an example apparatus 600 for launching start-stop function according to one or more embodiments. Referring to FIG. 6A, the apparatus may be applied in a server and include a second reception module 601, a second acquirement module 602, and a second transmission module 603.

The second reception module 601 may be configured to receive a traffic information acquiring instruction transmitted by a vehicle terminal. The traffic information acquiring instruction may carry current location information of a vehicle corresponding to the vehicle terminal.

The second acquirement module 602 may be configured to acquire traffic information of a road at which the vehicle is located currently based on the location information. The traffic information may indicate current traffic condition of the road.

The second transmission module 603 may be configured to transmit the traffic information to the vehicle terminal. The traffic information may be used by the vehicle terminal to launch the start-stop function for the vehicle.

Figure 6B:
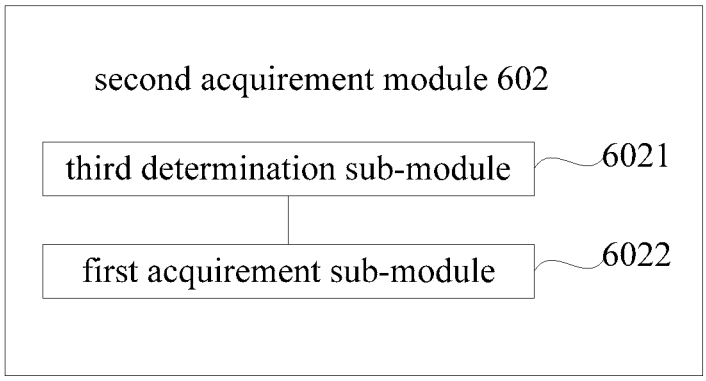
FIG. 6B is a block diagram illustrating an example second acquirement module according to one or more embodiments.

Optionally, referring to FIG. 6B, the traffic information is current traffic light information for location of a traffic light at which the vehicle is located. The second acquirement module 602 may include a third determination sub-module 6021 and a first acquirement sub-module 6022. The third determination sub-module 6021 may be configured to determine the location of the traffic light at which the vehicle is located based on the location information. The first acquirement sub-module 6022 may be configured to acquire the current traffic light information for the location of the traffic light.

Figure 6C:
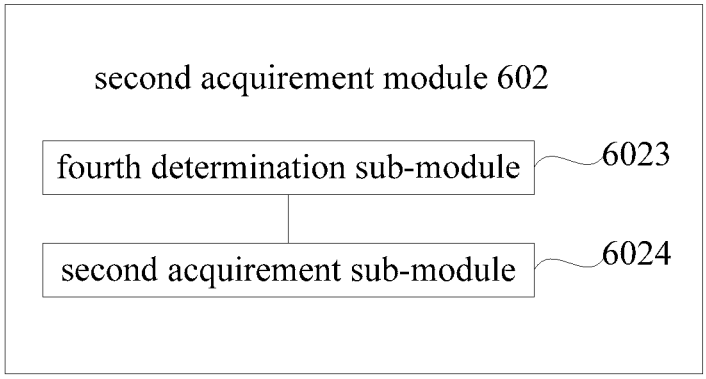
FIG. 6C is a block diagram illustrating an example second acquirement module according to one or more embodiments.

Optionally, referring to FIG. 6C, the traffic information is real time road condition information of the road. The second acquirement module 602 may include a fourth determination sub-module 6023 and a second acquirement sub-module 6024. The fourth determination sub-module 6023 may be configured to determine the road at which the vehicle is located currently based on the location information. The second acquirement sub-module 6024 may be configured to acquire the real time road condition information of the road.

According to example embodiments of the disclosure, the server may receive the traffic information acquiring instruction from the vehicle terminal, acquire the traffic information of the road at which the vehicle corresponding to the vehicle terminal is located currently based on the location information in the traffic information acquiring instruction, and transmit the acquired traffic information to the vehicle terminal. As a result, the vehicle terminal may determine whether to launch the start-stop function based on the traffic information, and thus it can avoid launching the start-stop function frequently within a short period since the start-stop function will be launch once the brake pedal is detected to be pressed without the traffic information. Therefore, it is convenient for the user in using the start-stop function and the user would be more willing to use the start-stop function, and thus usage and operation of the start-stop function is improved.

For the apparatuses in the above embodiments, specific operations performed by each module have been detailed in related method embodiments, and thus detailed description will be omitted here.

Figure 7:
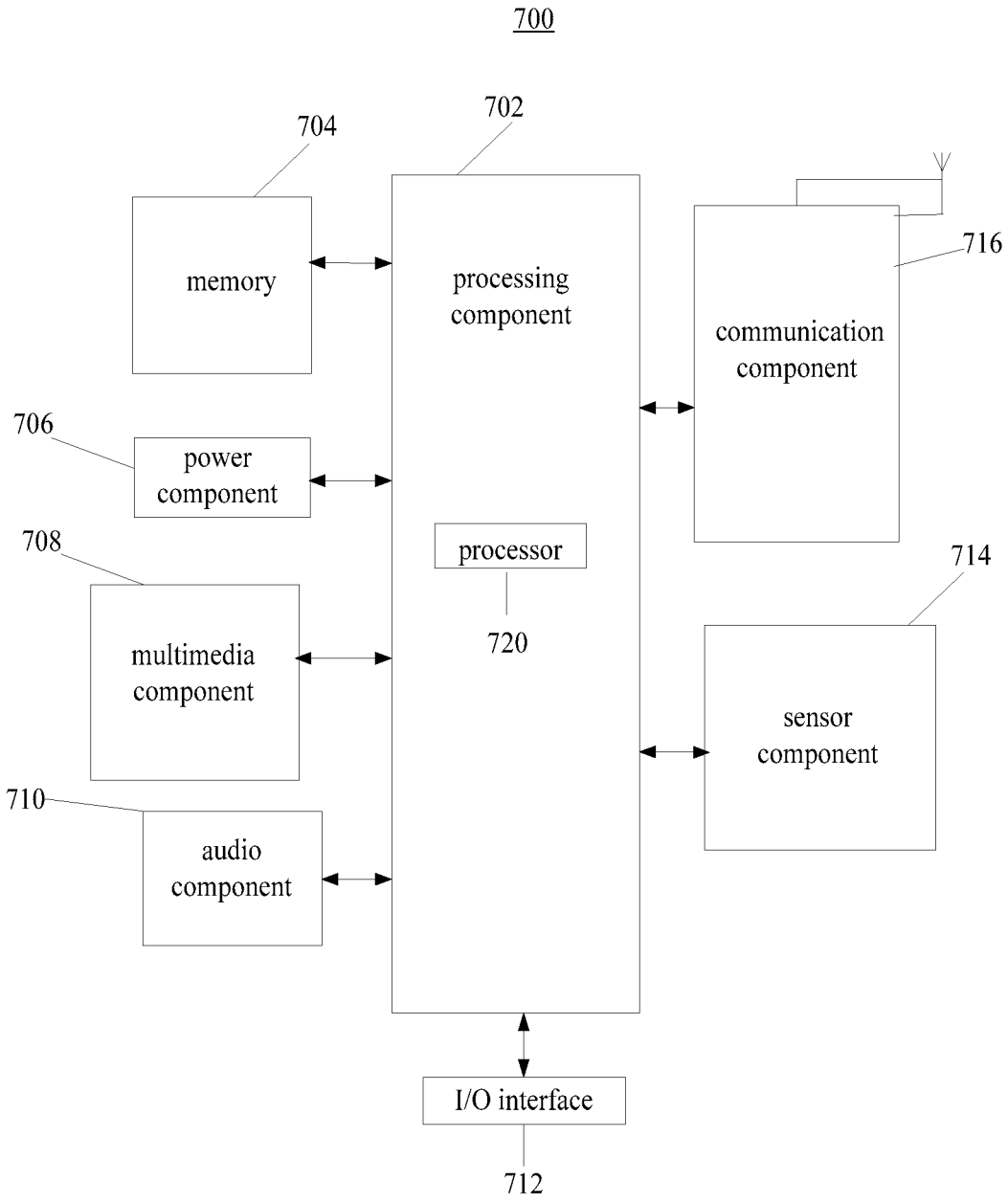
FIG. 7 is a block diagram illustrating an example apparatus for launching an engine start-stop function according to one or more embodiments.

FIG. 7 is a block diagram illustrating an example apparatus 700 for launching an engine start-stop function according to one or more embodiments. For example, the apparatus 700 may be a mobile phone, a computer, a digital broadcast terminal, a messaging device, a gaming console, a tablet, a medical device, exercise equipment, a personal digital assistant, and the like.

Referring to FIG. 7, the apparatus 700 may include one or more of the following components: a processing component 702, a memory 704, a power component 706, a multimedia component 708, an audio component 710, an input/output (I/O) interface 712, a sensor component 714, and a communication component 716.

The processing component 702 typically controls overall operations of the apparatus 700, such as the operations associated with display, telephone calls, data communications, camera operations, and recording operations. The processing component 702 may include one or more processors 720 to execute instructions to perform all or part of the steps in the above described methods. Moreover, the processing component 702 may include one or more modules which facilitate the interaction between the processing component 702 and other components. For instance, the processing component 702 may include a multimedia module to facilitate the interaction between the multimedia component 708 and the processing component 702.

The memory 704 is configured to store various types of data to support the operation of the apparatus 700. Examples of such data include instructions for any applications or methods operated on the apparatus 700, contact data, phonebook data, messages, pictures, video, etc. The memory 704 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 706 provides power to various components of the apparatus 700. The power component 706 may include a power management system, one or more power sources, and any other components associated with the generation, management, and distribution of power for the apparatus 700.

The multimedia component 708 includes a screen providing an output interface between the apparatus 700 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 708 includes a front camera and/or a rear camera. The front camera and the rear camera may receive an external multimedia datum while the apparatus 700 is in an operation mode, such as a photographing mode or a video mode. Each of the front camera and the rear camera may be a fixed optical lens system or have optical focusing and zooming capability.

The audio component 710 is configured to output and/or input audio signals. For example, the audio component 710 includes a microphone ("MIC") configured to receive an external audio signal when the apparatus 700 is in an operation mode, such as a call mode, a recording mode, and a voice recognition mode. The received audio signal may be further stored in the memory 704 or transmitted via the communication component 716. In some embodiments, the audio component 710 further includes a speaker to output audio signals.

The I/O interface 712 provides an interface between the processing component 702 and peripheral interface modules, the peripheral interface modules being, for example, a keyboard, a click wheel, buttons, and the like. The buttons may include, but are not limited to, a home button, a volume button, a starting button, and a locking button.

The sensor component 714 includes one or more sensors to provide status assessments of various aspects of the apparatus 700. For instance, the sensor component 714 may detect an open/closed status of the apparatus 700, relative positioning of components (e.g., the display and the keypad, of the apparatus 700), a change in position of the apparatus 700 or a component of the apparatus 700, a presence or absence of user contact with the apparatus 700, an orientation or an acceleration/deceleration of the apparatus 700, and a change in temperature of the apparatus 700. The sensor component 714 may include a proximity sensor configured to detect the presence of a nearby object without any physical contact. The sensor component 714 may also include a light sensor, such as a CMOS or CCD image sensor, for use in imaging applications. In some embodiments, the sensor component 714 may also include an accelerometer sensor, a gyroscope sensor, a magnetic sensor, a pressure sensor, or a temperature sensor.

The communication component 716 is configured to facilitate communication, wired or wirelessly, between the apparatus 700 and other devices. The apparatus 700 can access a wireless network based on a communication standard, such as WiFi, 2G or 3G; or a combination thereof. In one or more embodiments, the communication component 716 receives a broadcast signal or broadcast associated information from an external broadcast management system via a broadcast channel. In an example embodiment, the communication component 716 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In one or more embodiments, the apparatus 700 may be implemented with one or more circuitries, which include application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components. The apparatus 700 may use the circuitries in combination with the other hardware or software components for executing the method above. Each module, submodule, unit, or sub-unit disclosed above may be implemented at least partially using the one or more circuitries.

In one or more embodiments, there is also provided a non-transitory computer-readable storage medium including instructions, such as included in the memory 704, executable by the processor 720 in the apparatus 700, for performing the above-described methods. For example, the non-transitory computer-readable storage medium may be a ROM, a Random Access Memory (RAM), a CD-ROM, a magnetic tape, a floppy disc, an optical data storage device, and the like.

A non-transitory computer readable storage medium having stored therein instructions that, when executed by a processor of a mobile terminal, cause the mobile terminal to perform a method for launching start-stop function, including: transmitting to a server a traffic information acquiring instruction which carries current location information of a vehicle corresponding to the vehicle terminal and is used by the server to acquire traffic information of a road at which the vehicle is located currently based on the location information, the traffic information indicating current traffic condition of the road; receiving the traffic information transmitted by the server; and launching the start-stop function for the vehicle when the traffic information meets a preset condition.

Optionally, the method may further include: detecting current state of the vehicle; and acquiring the current location information of the vehicle when it is detected that the current state of the vehicle is a stop state.

Optionally, the traffic information is current traffic light information for location of a traffic light at which the vehicle is located. Launching the start-stop function for the vehicle when the traffic information meets preset condition may include: determining waiting time at a red light for the vehicle continuing to wait at a red light at the location of the traffic light based on the current traffic light information; and launching the start-stop function for the vehicle when the waiting time at the red light is longer than a preset threshold.

Optionally, the traffic information is real time road condition information of the road. The launching the start-stop function for the vehicle when the traffic information meets preset condition may include: determining congestion time for the road or traffic congestion index for the road based on the real time road condition information of the road; and launching the start-stop function for the vehicle when the congestion time is longer than a preset threshold or the traffic congestion index is a preset index.

Figure 8:
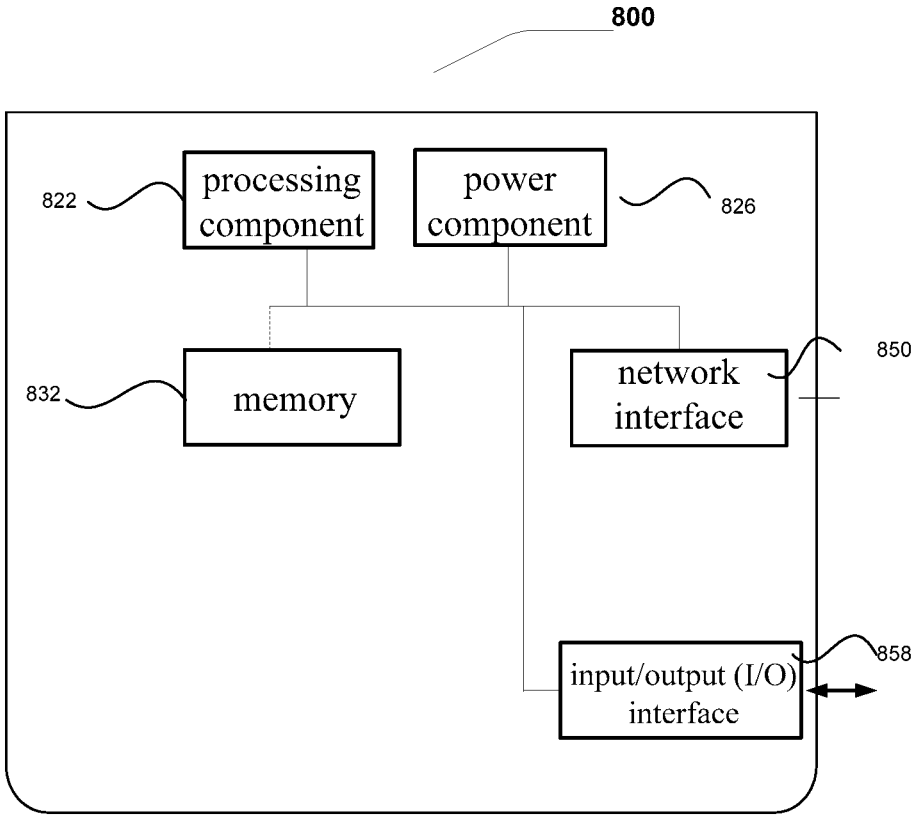
FIG. 8 is a block diagram illustrating an example apparatus for launching an engine start-stop function according to one or more embodiments.

FIG. 8 is a block diagram illustrating an example apparatus 800 for launching an engine start-stop function according to one or more embodiments. For example, the apparatus 800 may be provided as a server. Referring to FIG. 8, the apparatus 800 includes a processing component 822 which further includes one or more processors, and memory resource represented by a memory 832 for storing instructions that are executable by the processing component 822, such as an application. The application stored in the memory 832 may include one or more modules each corresponding to a set of instructions. In addition, the processing component 822 is configured to execute instructions to perform a method for launching start-stop function including: receiving a traffic information acquiring instruction transmitted by a vehicle terminal, the traffic information acquiring instruction carrying current location information of a vehicle corresponding to the vehicle terminal; acquiring traffic information of a road at which the vehicle is located currently based on the location information, the traffic information indicating current traffic condition of the road; and transmitting the traffic information to the vehicle terminal, the traffic information being used by the vehicle terminal to launch the start-stop function for the vehicle.

Optionally, the traffic information is current traffic light information for location of a traffic light at which the vehicle is located. Acquiring traffic information of the road at which the vehicle is located currently based on the location information may include: determining the location of the traffic light at which the vehicle is located based on the location information; and acquiring the current traffic light information for the location of the traffic light.

Optionally, the traffic information is real time road condition information of the road. Acquiring traffic information of the road at which the vehicle is located currently based on the location information may include: determining the road at which the vehicle is located currently based on the location information; and acquiring the real time road condition information of the road.

The apparatus 800 may also include a power component 826 configured to perform power management of the apparatus 800, a wired or wireless network interface 850 configured to connect the apparatus 800 to a network, and an input/output (I/O) interface 858. The apparatus 800 may operate based on an operating system stored in the memory 832, such as Windows Server™, Mac OS X™, Unix™, Linux™, FreeBSD™ or the like.

The terminology used in the present disclosure is for the purpose of describing exemplary embodiments only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

Other embodiments of the invention will be apparent to those skilled in the art from consideration of the specification and practice of the disclosures herein. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the invention being indicated by the following claims.

It will be appreciated that the inventive concept is not limited to the exact construction that has been described above and illustrated in the accompanying drawings, and that various modifications and changes can be made without departing from the scope thereof. It is intended that the scope of the invention only be limited by the appended claims.

What is claimed is:

1. A method, implemented in a vehicle terminal of a vehicle, for launching an engine start-stop function in the vehicle, the method comprising:

transmitting, from the vehicle terminal to a server, a traffic information acquiring instruction which carries current location information of the vehicle, the traffic information acquiring instruction and current location information being used by the server to acquire traffic information for a road on which the vehicle is located currently as determined based on the current location information, the traffic information indicating a current traffic condition corresponding with traffic flow on the road;

receiving, at the vehicle terminal, the traffic information transmitted by the server; and launching the engine start-stop function for the vehicle when the traffic information meets a preset condition, the preset condition corresponding with a period of time during which the vehicle is anticipated to remain stopped based on the traffic information, the start-stop function configured to stop the engine while the vehicle is stopped and restart the engine when the vehicle is to move again;

wherein the traffic information comprises real time road condition information for the road; and the launching the engine start-stop function for the vehicle when the traffic information meets the preset condition comprises:

determining a congestion time for the road or a traffic congestion index for the road based on the real time road condition information of the road; and launching the engine start-stop function of the vehicle when the congestion time is greater than a preset threshold or when the traffic congestion index satisfies a preset index condition, wherein the real time road condition information of the road comprises an estimated passing time when the road is congested and a historical passing time when the road is clear, and the method further comprises calculating a difference between the estimated passing time and the historical passing time and determining the calculated difference as the congestion time of the road.

2. The method of claim 1, before the transmitting to a server a traffic information acquiring instruction, further comprising:

detecting a current state of the vehicle; and acquiring the current location information of the vehicle when it is detected that the current state of the vehicle is a stop state.

3. The method of claim 1, wherein the traffic information further comprises current traffic light information for a traffic light at which the vehicle is located; and the launching the engine start-stop function for the vehicle when the traffic information meets the preset condition further comprises:

determining a waiting time at the traffic light for the vehicle continuing to wait at a red light at the traffic light based on the current traffic light information; and launching the engine start-stop function for the vehicle when the waiting time at the red light is greater than a preset threshold.

4. The method of claim 1, wherein the traffic information acquiring instruction is transmitted when the vehicle has come to a complete stop, when the vehicle has a deceleration value greater than a first threshold value, when the vehicle is decelerating while traveling at a speed that is below a second threshold value, or when the vehicle is decelerating while traveling on a road with a density of traffic lights exceeding a third threshold value.

5. The method of claim 1, wherein the current traffic condition comprises a combination selected from: number and speed of vehicles, number and stop-time of traffic lights, construction, accidents, broken-down vehicles, and weather-related factors.

6. An apparatus for launching an engine start-stop function in a vehicle, comprising:

a first transmission module configured to transmit to a server a traffic information acquiring instruction which carries current location information of the vehicle, the traffic information acquiring instruction used by the server to acquire traffic information for a road at which the vehicle is located currently as determined based on the location information, the traffic information indicating a current traffic condition for the road;

a first reception module configured to receive traffic information transmitted by the server; and a launch module configured to launch the engine start-stop function for the vehicle when the traffic information satisfies a preset condition, the preset condition corresponding with a period of time during which the vehicle is anticipated to remain stopped based on the traffic information, the start-stop function configured to stop the engine while the vehicle is stopped and restart the engine when the vehicle is to move again;

wherein the traffic information comprises real time road condition information for the road, and the launch module comprises:

a first determination sub-module configured to determine congestion time for the road or a traffic congestion index for the road based on the real time road condition information of the road; and a first launch sub-module configured to launch the engine start-stop function for the vehicle when the congestion time is greater than a preset threshold or when the traffic congestion index satisfies a preset index, wherein the real time road condition information of the road comprises an estimated passing time when the road is congested and a historical passing time when the road is clear, and the congestion time is determined as a difference between the estimated passing time and the historical passing time.

7. The apparatus of claim 6, further comprising:

a detection module configured to detect a current state of the vehicle; and a first acquirement module configured to acquire the current location information of the vehicle when it is detected that the current state of the vehicle is a stop state.

8. The apparatus of claim 6, wherein the traffic information further comprises current traffic light information for a traffic light at which the vehicle is located, and the launch module further comprises:

a second determination sub-module configured to determine waiting time at the traffic light for the vehicle continuing to wait at a red light at the traffic light as determined based on the current traffic light information; and a second launch sub-module configured to launch the engine start-stop function for the vehicle when the waiting time at the red light is greater than a preset threshold.

9. The apparatus of claim 6, wherein the traffic information acquiring instruction is transmitted when the vehicle has come to a complete stop, when the vehicle has a deceleration value greater than a first threshold value, when the vehicle is decelerating while traveling at a speed that is below a second threshold value, or when the vehicle is decelerating while traveling on a road with a density of traffic lights exceeding a third threshold value.

10. The apparatus of claim 6, wherein the current traffic condition comprises a combination selected from: number and speed of vehicles, number and stop-time of traffic lights, construction, accidents, broken-down vehicles, and weather-related factors.

11. A computer-readable medium having instructions thereon that when executed cause a vehicle terminal to:

transmit to a server a traffic information acquiring instruction which carries current location information for a vehicle, the traffic information acquiring instruction used by the server to acquire traffic information of a road at which the vehicle is located currently as determined based on the location information, the traffic information indicating current traffic condition of the road;

receive the traffic information transmitted by the server; and launch an engine start-stop function for the vehicle when the traffic information satisfies a preset condition, the preset condition corresponding with a period of time during which the vehicle is anticipated to remain stopped based on the traffic information, the start-stop function configured to stop the engine while the vehicle is stopped and restart the engine when the vehicle is to move again;

wherein the traffic information comprises real time road condition information of the road; and the instructions for launching the start-stop function for the vehicle when the traffic information satisfies the preset condition comprises instructions that when executed cause the vehicle terminal to:

determine a congestion time for the road or a traffic congestion index for the road based on the real time road condition information of the road; and launch the engine start-stop function for the vehicle when the congestion time is greater than a preset threshold or when the traffic congestion index satisfies a preset index condition, wherein the real time road condition information of the road comprises an estimated passing time when the road is congested and a historical passing time when the road is clear, and the congestion time is determined as a difference between the estimated passing time and the historical passing time.

12. The computer-readable medium of claim 11, wherein the instructions when executed cause the computer to:

detect a current state of the vehicle; and acquire the current location information of the vehicle when it is detected that the current state of the vehicle is a stop state.

13. The computer-readable medium of claim 11, wherein the traffic information further comprises current traffic light information for a traffic light at which the vehicle is located; and the instructions for launching the engine start-stop function for the vehicle when the traffic information satisfies the preset condition further comprises instructions that when executed cause the vehicle terminal to:

determine a waiting time at a red light for the vehicle continuing to wait at the red light at the location of the traffic light as determined based on the current traffic light information; and launch the engine start-stop function for the vehicle when the waiting time at the red light is greater than a preset threshold.

14. The computer-readable medium of claim 11, wherein the traffic information acquiring instruction is transmitted when the vehicle has come to a complete stop, when the vehicle has a deceleration value greater than a first threshold value, when the vehicle is decelerating while traveling at a speed that is below a second threshold value, or when the vehicle is decelerating while traveling on a road with a density of traffic lights exceeding a third threshold value.

15. The computer-readable medium of claim 11, wherein the current traffic condition comprises a combination selected from: number and speed of vehicles, number and stop-time of traffic lights, construction, accidents, broken-down vehicles, and weather-related factors.

* * * * *